US006575697B1

(12) United States Patent
Arilla et al.

(10) Patent No.: US 6,575,697 B1
(45) Date of Patent: Jun. 10, 2003

(54) DEVICE FOR FIXING A TURBINE FERRULE

(75) Inventors: Jean-Baptiste Arilla, Soisy sur Seine (FR); Sylvie Coulon, Bois Le Roi (FR); Pierre Debeneix, St Sauveur sur Ecole (FR); Florence Irène Noëlle Leutard, Samoreau (FR); Paul Rodrigues, Savigny sur Orge (FR); Patrice Jean Marc Rosset, Le Mee sur Seine (FR)

(73) Assignee: Snecma Moteurs, Paris (FR)

( * ) Notice: Subject to any disclaimer, the term of this patent is extended or adjusted under 35 U.S.C. 154(b) by 0 days.

(21) Appl. No.: 09/868,902

(22) PCT Filed: Nov. 9, 2000

(86) PCT No.: PCT/FR00/03126

§ 371 (c)(1),
(2), (4) Date: Oct. 17, 2001

(87) PCT Pub. No.: WO01/34946

PCT Pub. Date: May 17, 2001

(30) Foreign Application Priority Data

Nov. 10, 1999 (FR) ..... 99.14103

(51) Int. Cl.[7] ..... F01D 11/08

(52) U.S. Cl. ..... 415/173.1; 415/173.4

(58) Field of Search ..... 415/173.1, 173.4, 415/173.6, 174.4

(56) References Cited

U.S. PATENT DOCUMENTS

| | | | | |
|---|---|---|---|---|
| 5,197,853 A | | 3/1993 | Creevy et al. | |
| 5,320,486 A | | 6/1994 | Walker et al. | |
| 5,609,469 A | | 3/1997 | Worley et al. | |
| 5,641,267 A | * | 6/1997 | Proctor et al. | 415/173.1 |
| 5,669,757 A | | 9/1997 | Brackett | |
| 6,200,091 B1 | * | 3/2001 | Bromann et al. | 415/173.1 |
| 6,435,820 B1 | * | 8/2002 | Overberg | 415/173.1 |

* cited by examiner

*Primary Examiner*—Edward K. Look
*Assistant Examiner*—Igor Kershteyn
(74) *Attorney, Agent, or Firm*—Oblon, Spivak, McClelland, Maier & Neustadt, P.C.

(57) ABSTRACT

A joint between a turbine ring. The ring is jointed to a spacer of the turbine by a joint including hooks which fit together on one side, and an abutment of flanges as well as a mortise and tenon joint on the other side. According to the joint, the tenon and mortise are separated from the flanges in abutment to limit the plays in the axial direction, produced by design or by expansions, to increase mechanical strength and simplify manufacturing.

6 Claims, 4 Drawing Sheets

DEVICE FOR FIXING A TURBINE FERRULE

This invention pertains to a particular joint between a turbine ring, which has the function of edging the turbine by delimiting the gas flow stream, and a part called spacer which belongs to the structure of the turbine.

A modern joint is described in U.S. Pat. No. 5,197,853 and illustrated in FIG. 4. A turbine body 1 bears a spacer 2 which itself bears a ring 3. The jointing parts of the ring 3 with the spacer 2 comprise, upstream, a spacer hook 4 and a ring hook 5 which are fitted into one another: mounting of the ring 3 is performed by pushing the end of the ring hook 5 into the recess of the spacer hook 4, then pivoting the ring 3 so as to approach its opposite end, located downstream, to that of the spacer 2; the other jointing parts 6 are located on these downstream ends.

It concerns a spacer rim 7 first directed radially inwards, then downstream, and a ring rim 8, directed radially outwards then axially downstream; the ring rim 8 is formed as a circular groove forming a mortise 9 opening radially outwards in which is accommodated a portion of the spacer rim 7, which thus plays the role of a tenon, formed as a rib extending radially inwards. The end of the tenon has two parallel flanges 10 and 11 and they come and abut against the bottom of the mortise 9. Clips 12 are then fixed over the parallel ends of rims 7 and 8, so that its legs 13 and 14 clasp them and prevent them from coming apart. Separation between spacer 2 and ring 3 is also prevented by the fitting together of hooks 4 and 5 on the other side; the ring 3 may slightly play in the axial direction on spacer 2 within an excursion, the length of which is defined by the total play between the flanks of the flanges 10 and 11 and the flanks of the mortise 9, at the locations marked by reference numbers 15 and 16. These slipping movements are generated by thermal expansions and by downstream aerodynamic forces, which are produced by the gases of the central stream of the turbine.

Thus, the sealing between a chamber 17 surrounded by the spacer 3 and the outside is established downstream by the contact of cylindrical surfaces formed at the end of the flanges 10 and 11 and at the bottom of the mortise 9, and an axial play in the motion of ring 3 in spacer 2 remains around the spacer rim 7, between the flanks of the mortise 9. The axial play creates an air leak downstream from the system, but however it must remain in order to maintain the mounting of the ring by a swinging movement.

U.S. Pat. No. 5,669,757 relates to an enhancement of this layout, wherein the mortise is located on the spacer rim and its downstream flank is borne by a removable annular angle, and the tenon is located on the ring rim: mounting of the ring may then be performed by a purely axial movement and the distance between the upstream end of the ring and an adjacent ring may be reduced as no swinging movement can produce a blocking at this location. The angle is then inserted with a radial movement into a groove of the spacer support in order to close the mortise and the fastening clips are finally introduced under the rims and the angle in order to maintain the latter in place.

This enhancement has no reinforcing effect on the seal downstream as an axial play of the tenon in the mortise remains, either by design or as a consequence of deformations undergone by the relatively flexible angle and easy to swing when the angle pushes it downstream. The clips have then the extra function of opposing movements of the angle, which they are unable to do completely but this requires that they be given a circular extension of a complete turn. The actual presence of the angle which is an extra part, reduces the mechanical strength of the joint and makes it manufacturing complicated.

The invention relates to an enhanced joint between a turbine ring and its spacer, wherein the basics of this prior joint are substantially reinstated (fixation in the radial direction by hooks fitted together on one side, and by abutment faces of concentric rims on the other side; and limitation of the axial movement by a mortise and tenon system on this other side), but is superior as regards the cohesion of the fit, the protection of the spacer against excessive heatings and the mechanical strength.

It comprises various enhancements, the most notable of which is perhaps that the tenon and the mortise are located upstream from the abutment rims, which means that the seal and axial retention are provided by different portions separated from the spacer and the ring.

The advantage that the tenon and mortise give into the interior chamber (17 in FIG. 4), which is generally ventilated by fresh gas, is now obtained and thus are less exposed to heatings and to expansions. The slippings imposed on the seal surfaces of the rims are then reduced. They may even be virtually suppressed if the tenon and mortise are jointed with zero axial play, which may be obtained if the mortise is limited on one side by a flexible tab which deforms upon inserting the tenon therein. The tenon and mortise then provide an additional seal to gas leaks between the interior chamber and the flow stream, all the better that this is achieved by contact of plane surfaces. It then becomes possible to reduce the contact width between the spacer and ring rims, which provides the advantage of then lowering the heat transmissions from ring 3 to spacer 2.

Another enhancement now becomes possible: the clips which keep the rims clamped may have their core accommodated in the notches of these rims, which does not effect in any way the seal of the joint as the rims are separated at the location of the notches; but by pushing the cores of the clips towards the notches, their protruding outside the rims is prevented and the bulk size of the whole is thereby reduced; furthermore, the clips are used from now on for limiting the angular slipping movement of the rings of the spacer, by abutting against the side faces of the notches. So the pins of the prior realization and their bores which were the center of significant stress concentrations may therefore be suppressed. The notches are also responsible for the stress concentrations but which are less significant, because of their dimensions and their more regular shape.

The presence of the tenon on the ring is also advantageous, as generally the ring is made in monocrystalline material which is rather difficult to machine; it is seen that it is less difficult to produce a tenon than a mortise. The spacer is generally built in a material which is easier to machine, so that the mortise may be produced easily thereon, for example by forming a tab thereon, which contributes to surrounding the mortise in connection with an adjacent portion of the spacer.

There is nothing up to the opposite side, bearing the hooks, which may not be enhanced according to the invention: the ring hook may cover the spacer hook, unlike the prior design, which here again, also has the advantage of locally protecting the spacer from heatings produced by the stream.

The invention will now be described in detail with the help of the following figures which illustrate a preferred embodiment of it:

Figure 4:
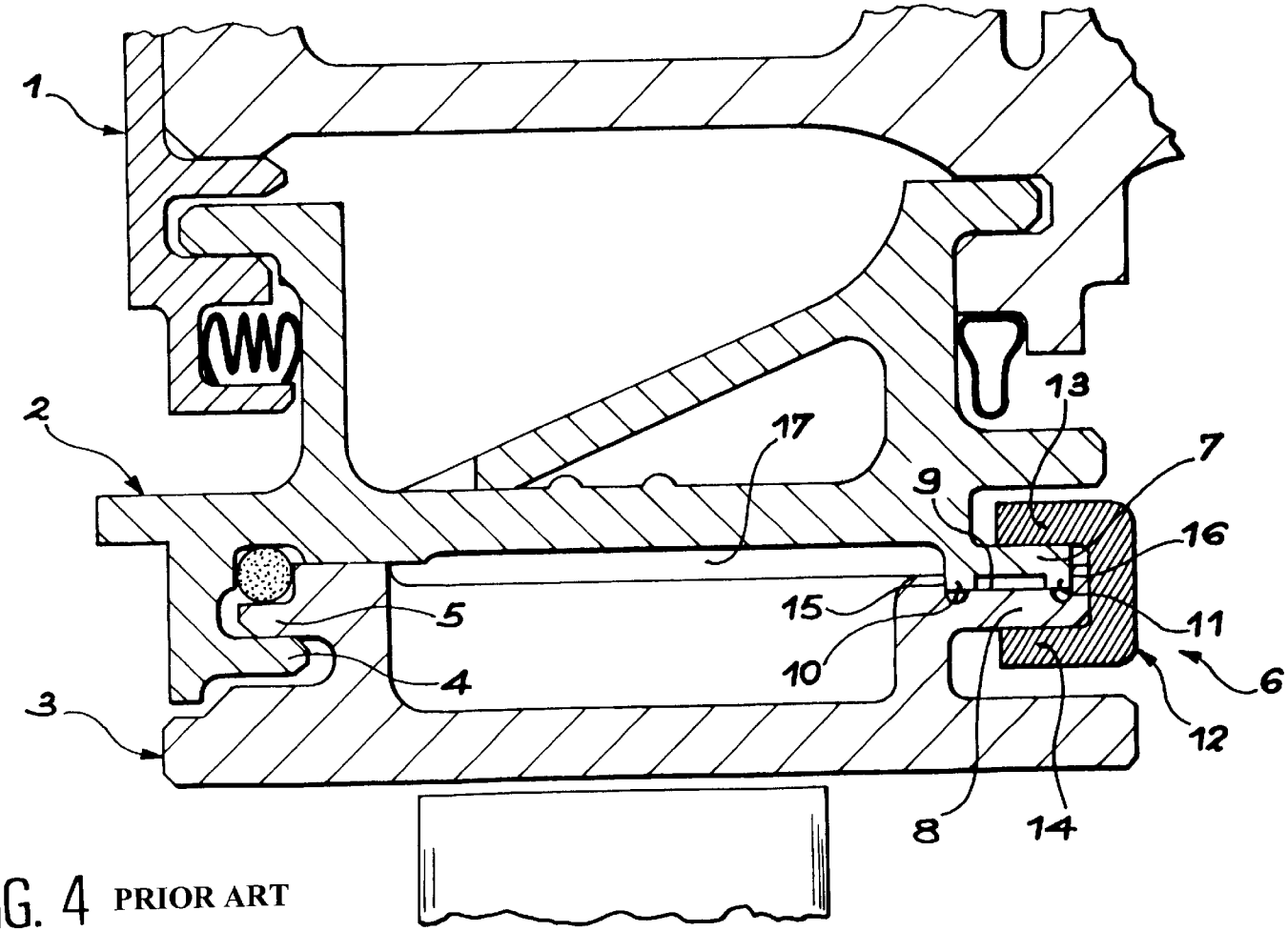
FIG. 4 PRIOR ART

FIG. 4, already described, illustrates the prior art.

Figure 1:
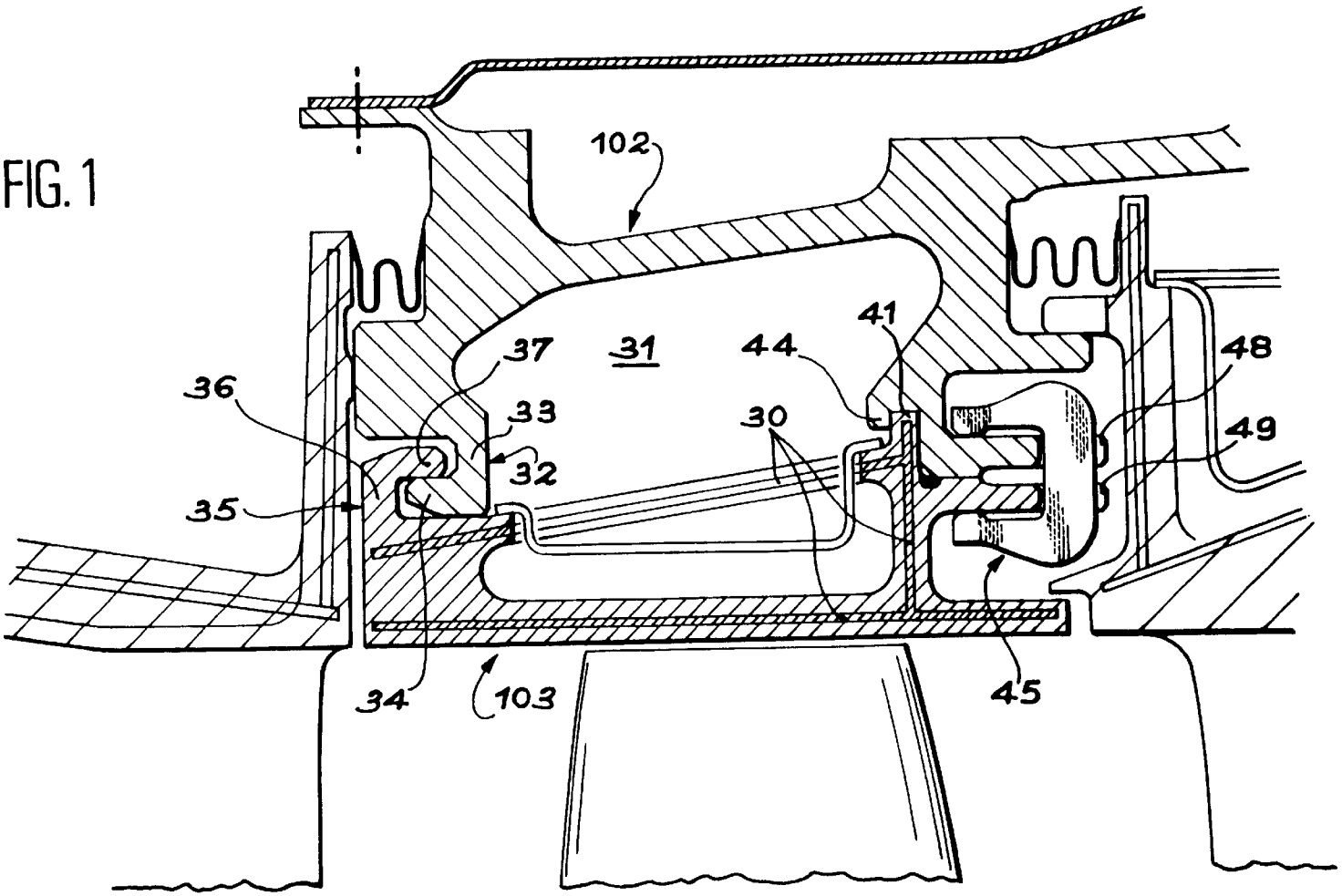
FIG. 1 is a general view of the invention.

FIG. 1 will now be discussed.

The spacer and the ring, the individual general shape of which remains similar to that of the known realization, here bear the respective reference numbers 102 and 103. They are conventionally formed of joined end-to-end segments along a circumference and the segments of the ring 103 bear lamellar gaskets 30 laid between the segments in order to limit gas flows in the radial and axial directions. A ventilation interior chamber 31 analogous to chamber 17 is delimited by the spacer 102 and ring 103. On the upstream side, spacer 102 bears a hook 32, the stem 33 of which, extending radially inwards, gives into the chamber 31 and the end 34 of which extends upstream; the hook 35 of the ring 103 extends outside the latter and covers it, with a stem 36 arriving in front of its end 34 and an end 37 arriving in front of stem 33; the hooks are thus inverted as compared with the prior design, but their joining by fitting into each other remains the same.

Figure 2:
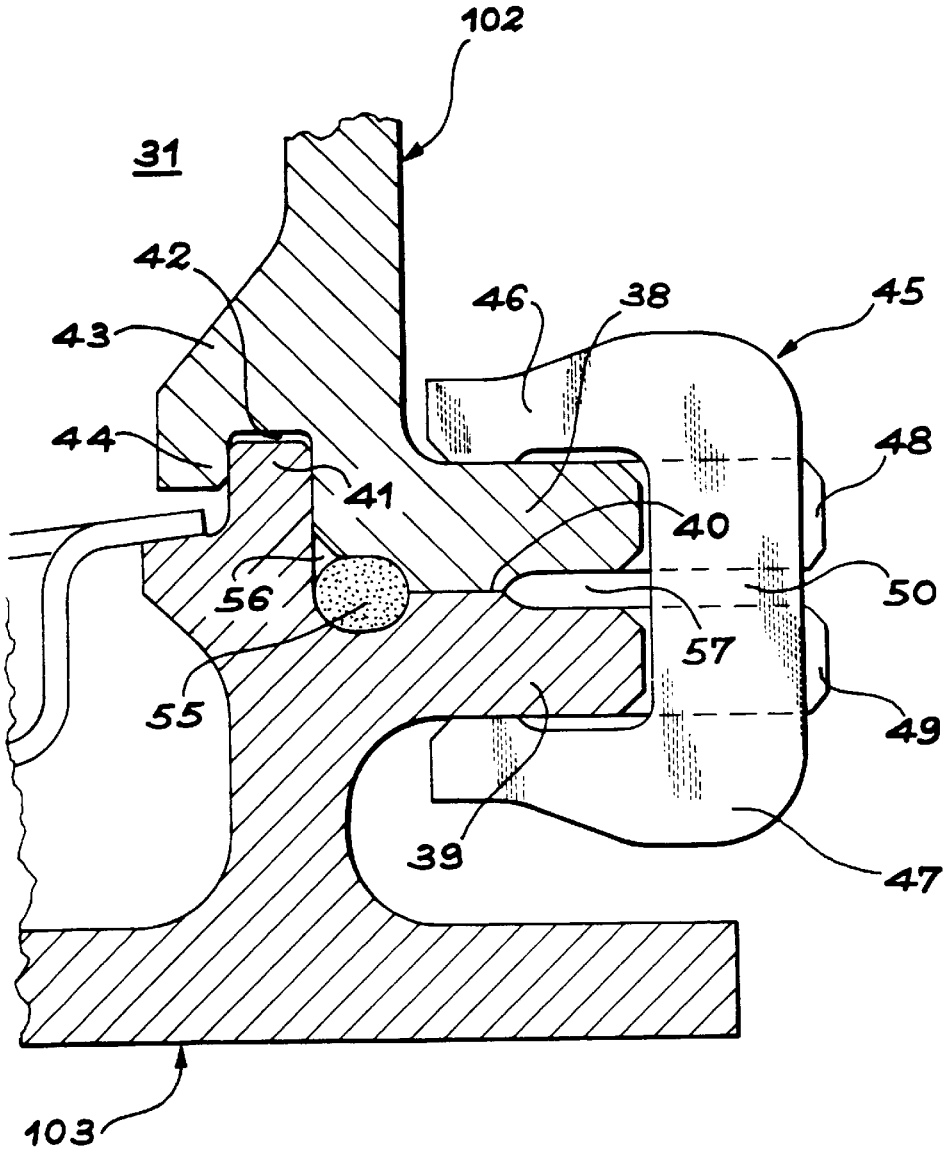
FIG. 2 is a detail of FIG. 1.
Figure 3:
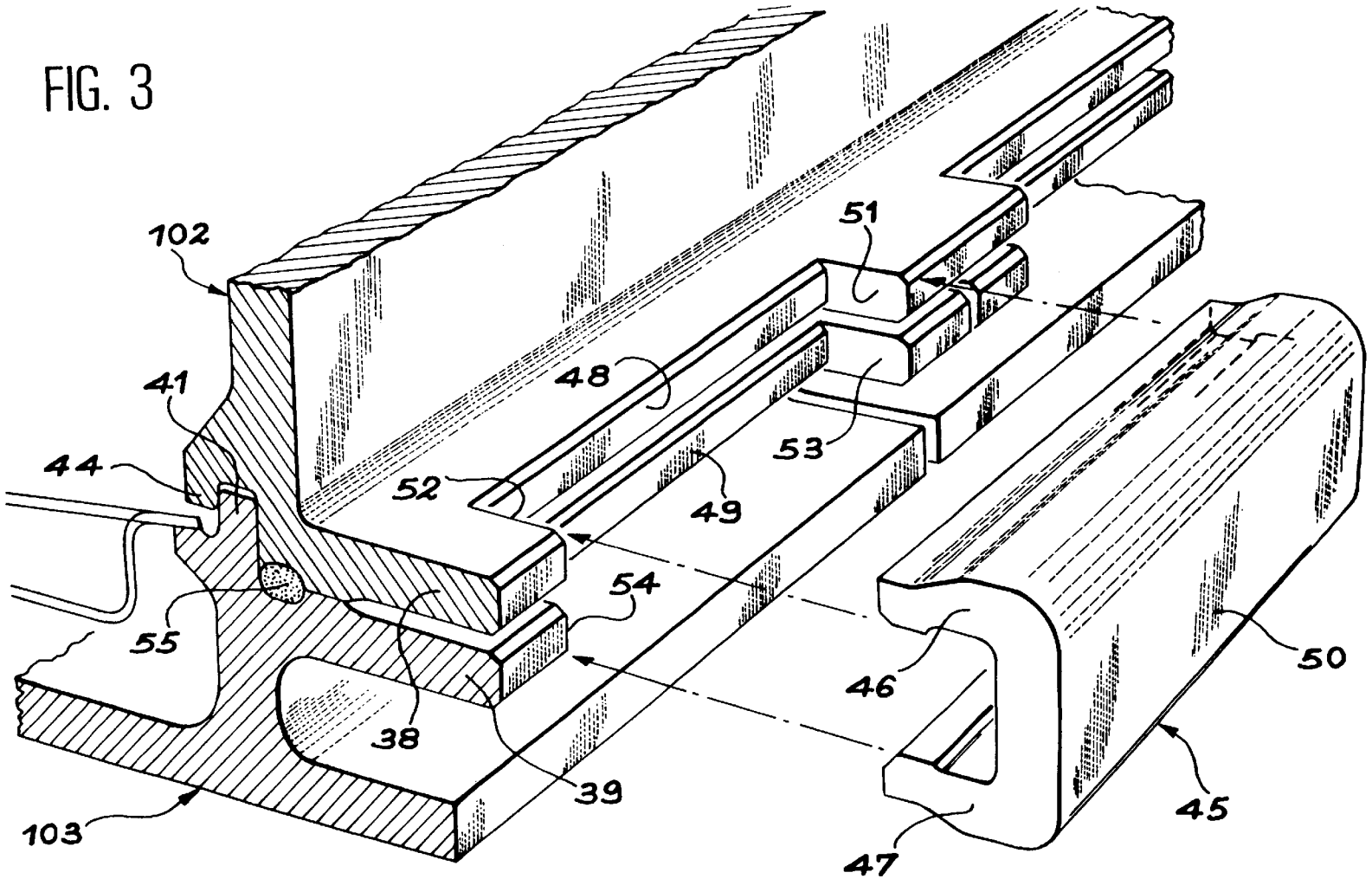
FIG. 3 is a perspective view of the parts of FIG. 2.

Now, reference will be made to the downstream side of the joint and mainly to FIGS. 2 and 3; spacer 102 and ring 103 are provided with rims 38 and 39 which extend in parallel downstream like the rims 7 and 8 of the prior design, but here the rim 38 of spacer 102 only comprises a flange 40 which establishes the abutment and the seal with a concentric flange of the rim 39; rims 38 and 39 are separated on the major portion of their length by play 57.

The clamping of the ring 103 on spacer 102 in the axial direction is due to a tenon 41 established on the ring 103 and located upstream from the rim 38 of the spacer 102, on the side of the ventilation chamber 31; this tenon is retained in a mortise 42, delimited by the rim 38 and especially by a curved tab 43, built on the rear face of this rim 38. The edge 44 of the tab 43 is flexible, so that it may bend when mounting is performed, in order to suppress play in the axial direction of the tenon 41 between rim 38 and tab 43; the low stiffness of the end 44 is such that moderate stresses may be introduced therein, which are not likely to become excessive during operation, when expansions and vibrations which are difficult to assess, have affected the joint.

Clips 45 are encountered once more, their legs 46 and 47 are used for tightening rims 38 and 39 together in order to maintain the abutment of flange 40; However, rims 38 and 39 are provided with notches 48 and 49 facing each other and sufficiently wide so that the central core 50 of the clip 45 may be slipped therein by pushing it upstream. The core 50 thus limits the angular movement of the ring 103 on the spacer 102 by means of abutments between the core 50 and the side faces 51, 52, 53 and 54 of the notches 48 and 49. Other means are no longer required for stopping these movements: the pins formerly used and slipped into the bores of the rims become unnecessary and are omitted.

A sealing gasket 55 may be inserted in a groove 56 cut out in one of the rims 39, at the location of the abutment faces, in order to enhance the seal there.

What is claimed is:

1. A joint between a turbine ring edging a spacer of a turbine structure comprising, on an upstream side, a ring hook and a spacer hook which are fitted together and, on a downstream side, a joining system comprising a spacer rim and a ring rim in abutment and clasped by clips, and a tenon and mortise for axial retention formed on the ring and the spacer, wherein the tenon is engaged in the mortise, and wherein the tenon and mortise are located upstream from the rims in abutment.

2. The joint according to claim 1, wherein the mortise is delimited by a flexible tab of the spacer, and wherein the tenon is engaged in the mortise with zero play.

3. The joint according to claim 2, wherein the spacer rim and the abutment rim are in abutment on a portion of their length and separated by play on another portion of their length.

4. The joint according to claim 3, wherein the rims are provided with notches facing each other receiving a core of the clips.

5. The joint according to claim 1, wherein the tenon and mortise give into an interior chamber delimited by the spacer and by the ring.

6. The joint according to claim 1, wherein the hook of the ring covers the hook of the spacer.

* * * * *